US008739333B2

(12) United States Patent
Boyle et al.

(10) Patent No.: US 8,739,333 B2
(45) Date of Patent: Jun. 3, 2014

(54) BEDBUG INFESTATION-RESISTANT BED

(75) Inventors: Michelle Boyle, Sherwood, OR (US); David L. Brown, Fairview, OR (US)

(73) Assignee: Central City Concern, Portland, OR (US)

( * ) Notice: Subject to any disclaimer, the term of this patent is extended or adjusted under 35 U.S.C. 154(b) by 941 days.

(21) Appl. No.: 12/798,497

(22) Filed: Apr. 5, 2010

(65) Prior Publication Data

US 2011/0239368 A1 Oct. 6, 2011

(51) Int. Cl.
*A47C 19/00* (2006.01)

(52) U.S. Cl.
USPC ..... 5/400; 5/411; 5/200.1; 5/201; 5/110; 5/111; 5/112

(58) Field of Classification Search
USPC ..... 5/400, 411, 200.1, 201, 202, 110–112, 5/114
See application file for complete search history.

(56) References Cited

U.S. PATENT DOCUMENTS

| | | | | |
|---|---|---|---|---|
| 1,624,965 | A | | 4/1927 | Moore |
| 1,682,440 | A | | 8/1928 | Sutfin |
| 1,903,404 | A | | 4/1933 | Abrams |
| 2,118,050 | A | | 5/1938 | Martin |
| 2,123,326 | A | | 7/1938 | Basile |
| 2,635,256 | A | | 4/1953 | Driskill |
| 2,772,424 | A | | 12/1956 | Roche et al. |
| 2,853,716 | A | | 9/1958 | Sevcik |
| 2,871,489 | A | * | 2/1959 | Emmert ..... 5/114 |
| 2,924,830 | A | | 2/1960 | De Long |
| 3,061,870 | A | | 11/1962 | Giannini, Sr. |
| 3,230,555 | A | | 1/1966 | Hooker |
| 3,995,334 | A | | 12/1976 | Harris |

(Continued)

FOREIGN PATENT DOCUMENTS

| | | |
|---|---|---|
| CH | 670943 | 4/1989 |
| EP | 1493360 | 1/2005 |

(Continued)

OTHER PUBLICATIONS

International Search Report from PCT/US11/31076, dated Jun. 20, 2011 (13 pgs).

(Continued)

*Primary Examiner* — Robert G Santos
*Assistant Examiner* — David E Sosnowski
(74) *Attorney, Agent, or Firm* — Ater Wynne LLP

(57) ABSTRACT

A bedbug-resistant bed comprises a horizontal right-rectangular frame including four open angled rigid members pairwise joined at their eight termini in four corners; one or more support members extending across the frame near the upper edge of the joined angled members; and a right-rectangular wire mesh infill expanse extending within a perimeter of the frame and affixed along upper inwardly extending expanses of the joined angled members. A bedbug-resistant bed in another embodiment comprises two right-rectangular horizontal frames differentially dimensioned in three orthogonal axes such that one of the two frames is fittable within a three-dimensional enclosure defined by the other of the two frames for stowage of the bed, the two frames configured in deployment in a proximate side by side arrangement, each frame including four open angled rigid members joined at their eight termini to define a perimeter and four corners of the frame, each frame further including one or more solid support members extending across the frame, and each frame further including four legs extending downwardly from the four corners of the frame.

9 Claims, 3 Drawing Sheets

(56) References Cited

U.S. PATENT DOCUMENTS

| | | | | |
|---|---|---|---|---|
| 4,325,561 | A | 4/1982 | Lynn | |
| 4,774,733 | A | 10/1988 | Akers | |
| 4,870,711 | A | 10/1989 | Felix | |
| 4,879,774 | A | 11/1989 | Sanders | |
| 4,958,390 | A * | 9/1990 | Mendenhall | 5/110 |
| 5,003,649 | A | 4/1991 | Kelly | |
| 5,233,707 | A | 8/1993 | Perkins | |
| D355,988 | S | 3/1995 | Brooking | |
| 6,125,484 | A | 10/2000 | Thomson | |
| 6,513,178 | B1 | 2/2003 | Kelly et al. | |
| 6,701,548 | B2 | 3/2004 | Vigneron | |
| 6,925,665 | B1 | 8/2005 | Hennings | |
| 7,017,205 | B2 | 3/2006 | Gladney | |
| 7,086,100 | B1 * | 8/2006 | Lo | 5/110 |
| 7,096,523 | B2 | 8/2006 | Hennings et al. | |
| 7,458,116 | B2 * | 12/2008 | Kelly et al. | 5/110 |
| 2007/0017026 | A1 * | 1/2007 | Lam | 5/127 |
| 2008/0313810 | A1 | 12/2008 | Cretsinger et al. | |
| 2009/0307838 | A1 | 12/2009 | Claffy et al. | |
| 2011/0239366 | A1 * | 10/2011 | Boyle et al. | 5/9.1 |

FOREIGN PATENT DOCUMENTS

| | | |
|---|---|---|
| FR | 2541101 | 8/1984 |
| FR | 2668910 | 5/1992 |
| GB | 9015566.4 | 7/1990 |
| GB | 9406780.8 | 4/1994 |

OTHER PUBLICATIONS

Duramax Duracot; Glasspec Corporation; http://www.glasspec.com/furniture/Beds_3.aspx; Sep. 3, 2010 (1 page).

Cots; Mahar Manufacturing; http://www.mahar.net/cots.html; Sep. 3, 2010 (3 pages).

Oasis Toddler Stacking Cot; Oasis; http://www.amazon/com/OASIS-Toddler-Stacking-Cot-Made-Warranty-HIGH/dp/B000F2J . . . ; Sep. 3, 2010 (2 pages).

Guidelines for Prevention and Management of Bed Bugs in Shelters and Group Living Facilities; New York State IPM Program, as part of Cornell Cooperative Extension; Sep. 3, 2010 (2 pages).

Stack-A-Bunk; Norix Intensive Use Furniture; http://www.norix.com/stackabunk.asp; Sep. 3, 2010 (4 pages).

* cited by examiner

DETAIL A

BEDBUG INFESTATION-RESISTANT BED

FIELD OF THE INVENTION

The invention relates generally to the field of beds. More particularly, the invention relates to bed frames and mattresses.

BACKGROUND OF THE INVENTION

Conventional beds found in homes include a four-post frame supporting a rigid innerspring or so-called "box-spring" mattress and a more yielding and softer mattress thereabove, sometimes integral therewith. Frames conventionally come in a few standard sizes, e.g. double, queen, and king, and in myriad configurations, e.g. convertible couch, sleigh, canopy, futon, and others emphasizing buyer comfort and aesthetics, e.g. dark colors (brown, for example) and/or textured surfaces. Most conventional corner posts or legs are made of closed, tubular, e.g. cylindrical, form (characterized by hollow regions defined by penetrable seams) that extends from a perimeter, innerspring mattress frame to the floor on which the bed rests. Many beds include a complementary frame-attached or -detached headboard or floor-supported drawers set often containing upholstered sections and/or cubbies or other covered or enclosed spaces. Some lower-priced vendors of beds and accessories have been known to give away cheap, size-adjustable metal frames with the purchase of a set of mattresses. Box-spring mattresses are known to create undesirably safe harbors for bedbugs.

In institutional settings, e.g. homeless shelters, low-income housing, prisons and jails, dormitories, apartments, hospitals, motels and hotels, and the like, high-density and short-term or otherwise turnover-prone use is common. Moreover, many such institutional settings are fraught with infestation by bugs. Invasive, parasitic, and difficult-to-detect (light brown) bedbugs are an especially common pest, and are nearly invisible to the naked eye, especially in their larva stage of development. (Bedbugs used to be eradicated by the use of DDT, now a banned environmentally hazardous material. Thus bedbug infestations are an increasingly common problem. Those of skill in the art will appreciate that the bedbug commonly has been referred to in the alternative as wall louse, mahogany flat, crimson rambler, heavy dragoon, chinche, chilly billy, and redcoat. Scientifically speaking, bedbugs are of the family Cimicidae of the suborder Heteroptera. The most prevalent human predator variety of bedbug is the Cimex Lectularius.) Mature bedbugs and their even tinier larvae notoriously and insidiously harbor in box-spring mattresses, pillows, bedding, and other penetrable and enclosed or other hiding places. Bedbugs are voracious and nocturnal feeders that find a human host on whose blood to engorge in the dark, typically at night, evidence of the presence of which is more often felt (painfully, the next morning, in the form of bites) than seen.

Figure 5:
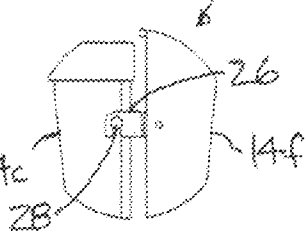
FIG. 5 is a side elevation of the bed corresponding with FIG. 4.
Figure 5:
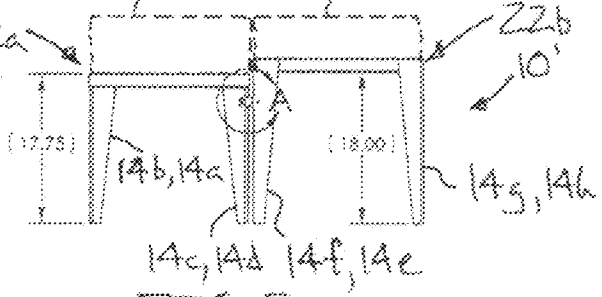

DETAIL A is a fragmentary enlarged detail corresponding to FIG. 5.

DETAILED DESCRIPTION OF THE PREFERRED EMBODIMENTS

Figure 1:
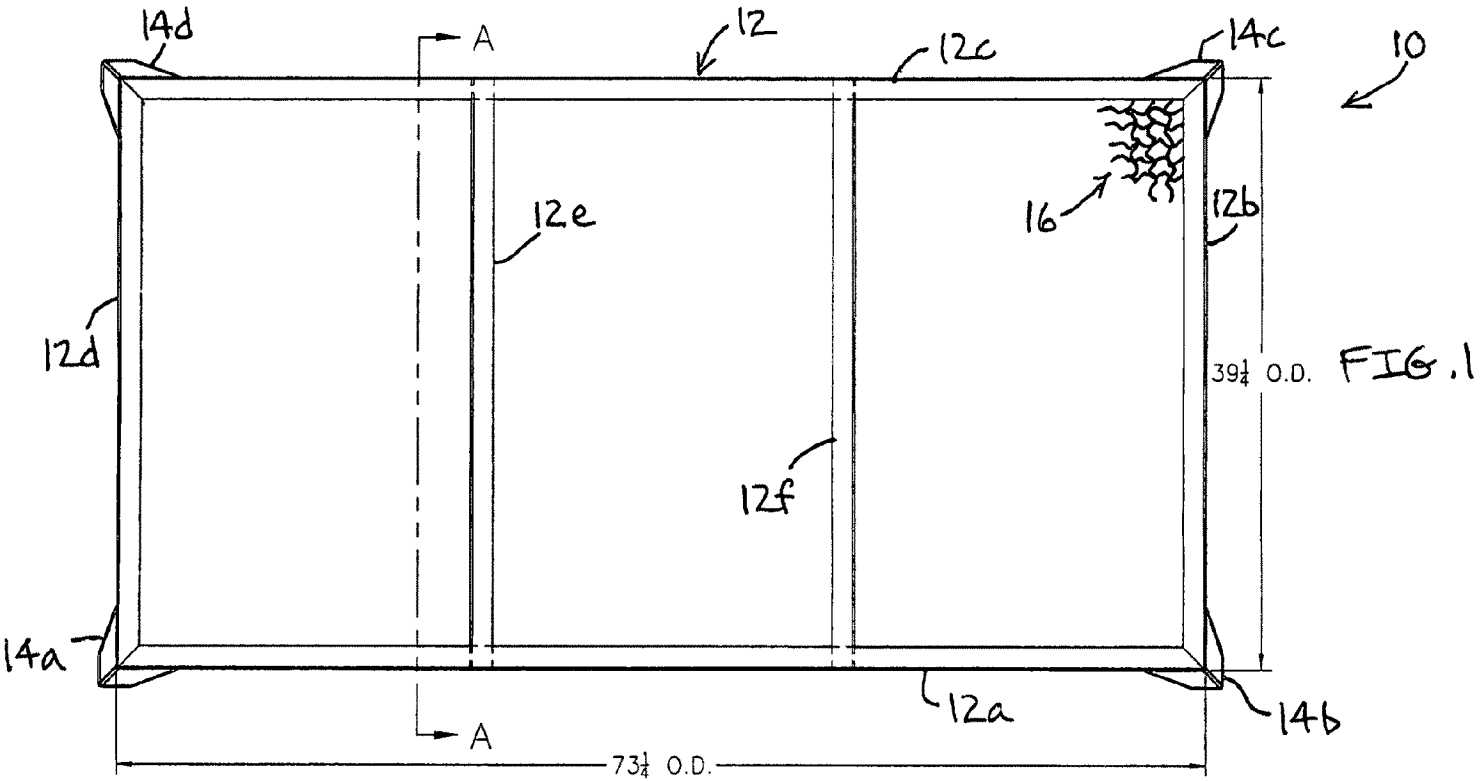
FIG. 1 is a top plan view of a bed made in accordance with one embodiment of the invention illustrating the space-saving vertical stacking thereof.
Figure 2:
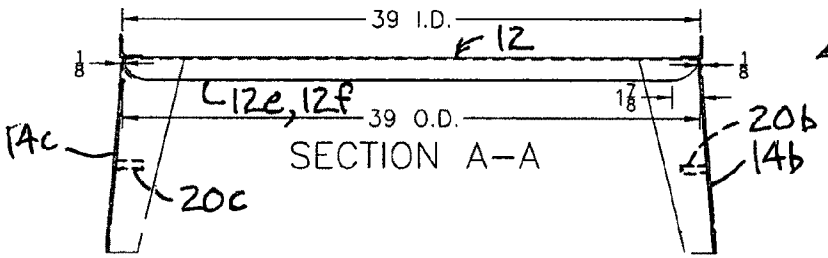
FIG. 2 is a cross-sectional end view of the bed taken along the lines A-A of FIG. 1.
Figure 3:
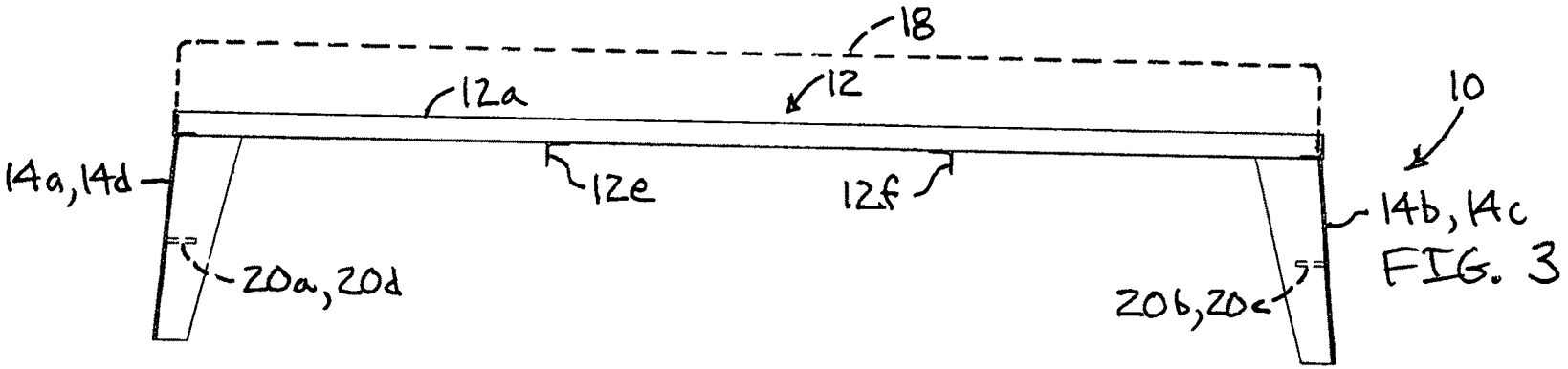
FIG. 3 is a front elevation of the bed corresponding with FIG. 1.

FIGS. 1, 2, and 3 collectively illustrate the invented bed 10 in accordance with one embodiment of the invention. Bed 10 in this embodiment includes a right-rectangular perimeter frame 12 supported by four corner legs 14*a*, 14*b*, 14*c*, 14*d*. Frame 12 may be seen to include four open angled rigid members 12*a*, 12*b*, 12*c*, 12*d* pair-wise joined (e.g. 12*a* to 12*b*, 12*b* to 12*c*, 12*c* to 12*d*, and 12*d* to 12*a*) at their eight termini in four (preferably 45° mitered) corners thereof. Bed 10 further includes one or more (e.g. two) angled brace support members 12*e*, 12*f* extending across the frame and extending into the inside, lower, right-rectangular edges of the joined angled members (refer briefly to FIGS. 1 and 2). Bed 10 further includes a right-rectangular wire mesh infill expanse 16 extending across and joined around its perimeter to the inside, lower edges of joined angled members 12*a*, 12*b*, 12*c*, and 12*d*. In accordance with one embodiment, all joints are made by spot- and/or seam-welding, for reasons that will become clear, although alternative but suitable means may be employed.

Those of skill in the art will appreciate that bed 10 in accordance with one embodiment of the invention is approximately thirteen inches in height, thirty-nine inches in width, and seventy-three inches in length. Of course, these dimensions are nominal and are selected to correspond nominally with a standard bed height (including mattress) and a standard double bed mattress size in terms of width and length. Thus, other dimensions are contemplated as being within the spirit and scope of the invention. Bed 10 may also include a somewhat flexible, preferably solid foam mattress 18 (shown in dashed outline in FIG. 3) of nominal five inch or other desired thickness extendable across and supportable by infill expanse 16, which in turn extends within a perimeter of frame 12 with its outside edges mounted to upper, inwardly extending expanses of the joined angled frame members 12*a*, 12*b*, 12*c*, and 12*d*.

No inner-spring or box-spring mattress is used, in accordance with the invention, for reasons that also will become clear.

In accordance with one embodiment of the invention, legs 14*a*, 14*b*, 14*c*, and 14*c* are made of rigid, preferably metallic material having great shear or weight-bearing strength. By "great" of course is meant capable of readily supporting a sleeping human being, e.g. bed 10 might be designed with a load-bearing capacity of up to 300 pounds or more, e.g. 600 pounds. Also, frame members 12*a*, 12*b*, 12*c*, 12*d*, 12*e*, and 12*f* are made of a similarly rigid, preferably metallic material. In accordance with one embodiment of the invention, the material is open (rather than tubular, columnar, cylindrical, etc.) formed metal such as steel having a smooth finish on all exterior surfaces. In accordance with one embodiment of the invention, the smooth steel surfaces are powder coated and painted, respectively, to reduce frictional engagement with the feet of a bug that otherwise might attempt to crawl up or along it and to make any such assault highly visible by color contrast therewith. Wire mesh infill expanse 16 (shown only in FIG. 1 and only in part, for the sake of clarity) preferably is formed by weaving coated steel wires in a criss-cross pattern, as is known, preferably with substantially open weave pattern, e.g. on an approximately 1 inch square grid that is approximately 90% open. Those of skill in the art will appreciate that alternative materials having suitably similar rigidity and durability characteristics are contemplated as being within the spirit and scope of the invention.

Also in accordance with one embodiment of the invention, angled frame members 12*a*, 12*b*, 12*c*, and 12*d* and angled brace support members 12*e* and 12*f* are dimensioned approximately 1½ inches on a side and approximately one-eighth inch thick (⅛ inch). Those of skill in the art will appreciate that support members 12*e* and 12*f* alternatively may be flat members so long as they provide sufficient support and safety. Preferably, corner legs 14*a*, 14*b*, 14*c*, and 14*d* are formed of ⅛ inch thick steel. Those of skill in the art will appreciate that alternative dimensions are contemplated for use as being within the spirit and scope of the invention.

Those of skill in the art will appreciate that in accordance with one embodiment of the invention, legs 14*a*, 14*b*, 14*c*, and 14*d* are splayed in a downward, outward angle θ from frame 12 in both a long and transverse axis of bed 12 (refer to FIGS. 2 and 3). Angle θ will be understood to permit plural ones of beds 10 to be stacked atop one another (in a generally vertical stacking orientation) for stowing beds away when not in use. Angle θ will also be understood to some extent to determine the vertical stacking density of the plural beds and thus the amount of space between vertically adjacent frames. In accordance with one embodiment of the invention, θ is between approximately three and approximately eight degrees from vertical, and preferably approximately five degrees. Those of skill in the art also will appreciate that the symmetric splay of all four legs downwardly and outwardly from the rectangular frame also provides a relatively open, tapered space or gap between the length of the legs and a mating wall. This, even when the bed in this embodiment of the invention is pushed against a wall or into a corner, even when the bed in this embodiment of the invention is pushed against a wall or into a corner, there is no safe harbor therebetween for bedbug infestations.

Those of skill in the art also will appreciate that in accordance with one embodiment of the invention, legs 14*a*, 14*b*, 14*c*, and 14*d* are somewhat tapered along their downward extent, as best shown in FIGS. 2 and 3. Such a taper gives the legs sufficient rigidity and shear strength and a sufficient upper welding angular extent while lowering the overall weight of the bed and minimizing adjacent legs' overlapping surface area when the beds are stowed in a nominally vertical stack. Those of skill in the art will appreciate that, to avoid safety and discomfort issues, either end of either brace support member 12*e* and 12*f* can, as illustrated, be cut or machined with a smooth radius (e.g. approximately 1⅞ inches) to avoid an otherwise sharp corner feature (refer briefly to FIG. 2).

FIG. 3 shows another feature of bed 10 that enables more accurate vertical stacking of beds. Within the interior of legs 14*a*, 14*b*, 14*c*, and 14*d* are provided four stops 20*a*, 20*b*, 20*c*, and 20*d* that confront and stop the downward movement of an identical bed stacked thereabove. Thus, each bed 10 when stacked above another bed comes to rest with its stops against the corresponding corners of the lower bed's frame, causing each bed to "stand" above the other at a fixed height and a substantially horizontal orientation thereabove. The stops in accordance with one embodiment of the invention are mounted (as by welding) approximately intermediate the lengths of the legs. This placement of the stops relative to the height of the bed produces a consistent minimum spacing between adjacently vertically stacked beds, thus ensuring there is no harbor for bedbugs in relatively closed or semi-closed regions therebetween. Those of skill in the art will appreciate that stops 20*a*, 20*b*, 20*c*, and 20*d* can be made of any suitable size and shape, e.g. triangular or square or pie-wedge shaped, ⅛ inch steel such as that cut and removed from brace support members 12*e* and 12*f* to render their otherwise sharp, right-angled corners rounded.

Those of skill in the art will appreciate that alternative placement for the stops is contemplated—wherein higher or lower placement along the legs respectively increases or decreases vertical stacking density. Advantages of using such stops instead of allowing the legs of the stacked beds to interference fit with one another include the fact that parallel planar orientation of the stacked beds is ensured and the fact that the beds are easier to pull apart for quicker deployment and use.

Thus, the splay and taper of the stop-equipped legs of the invented bed render them relatively strong but relatively light-weight so that they can be readily slid into a desired position, stacked one on top of another, transported from one facility to another, and deployed or stowed (e.g. by stacking) as desired without inviting a bedbug invasion into tiny spaces or semi-enclosed regions formed therebetween.

FIGS. 4, 5, 6, and 7 and DETAIL A collectively illustrate a bed in accordance with another embodiment of the invention. Those of skill in the art that identical features between the two embodiments are identically reference-designated, while similar features therebetween are similarly reference-designated using a prime, e.g. bed 10'.

Bed 10' includes two nearly identical, narrow, right-rectangular horizontal frames 22*a* and 22*b* including four angled steel perimeter frame members and including one or more angled or flat steel brace support members as described generally above with reference to frame 12 of bed 10.

Figure 4:
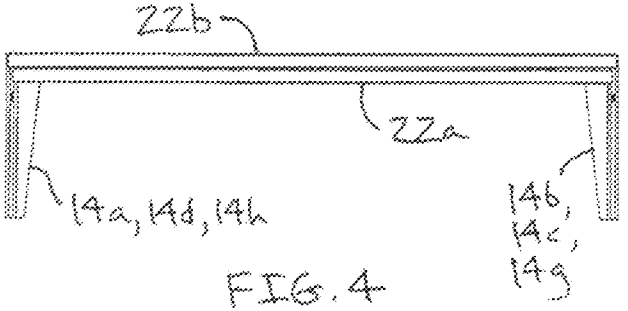
FIG. 4 is a top plan view of a bed made in accordance with another embodiment of the invention illustrating the space-saving enclosed nesting thereof.

Frames 22*a* and 22*b* are slightly differentially dimensioned in three orthogonal axes such that the smaller of the two frames is fittable within a three dimensional enclosure defined by the larger of the two frames for nested stowage of bed 10' as shown in FIG. 4. Alternatively, when bed 10' is deployed for use, the two frames 22*a* and 22*b* are configured in a proximate, side-by-side arrangement shown in FIGS. 5, 6, and 7. Descending downwardly at right angles from smaller frame 22*a* are tapered legs 14*a*, 14*b*, 14*c*, and 14*d*. Descending downwardly at right angles from larger frame 22*a* are tapered legs 14*e*, 14*f*, 14*g*, and 14*h*. Legs 14*a*, 14*b*, 14*c*, 14*d*, 14*g*, and 14*h* are configured with angled steel as described above, whereas legs 14*e* and 14*f* are configured with flat steel of approximately ⅜ inch thickness to compensate for the fact that these legs are not angled. It is this differential configuration that permits smaller frame 22*a* to slide underneath and within larger frame 22*b* in a nested, space-saving combination.

Frames 22*a* and 22*b* of bed 10' each include one or more (e.g. one) brace support member 12*ae'* and 12*be'*, as shown, which may be of flat ⅛ inch formed steel.

In accordance with one embodiment of the invention, frames 22*a* and 22*b* of bed 10' are dimensioned to have an approximately ¼ inch clearance. Those of skill in the art will appreciate that other clearances, whether smaller or larger, are contemplated as being within the spirit and scope of the invention.

Figure 7:
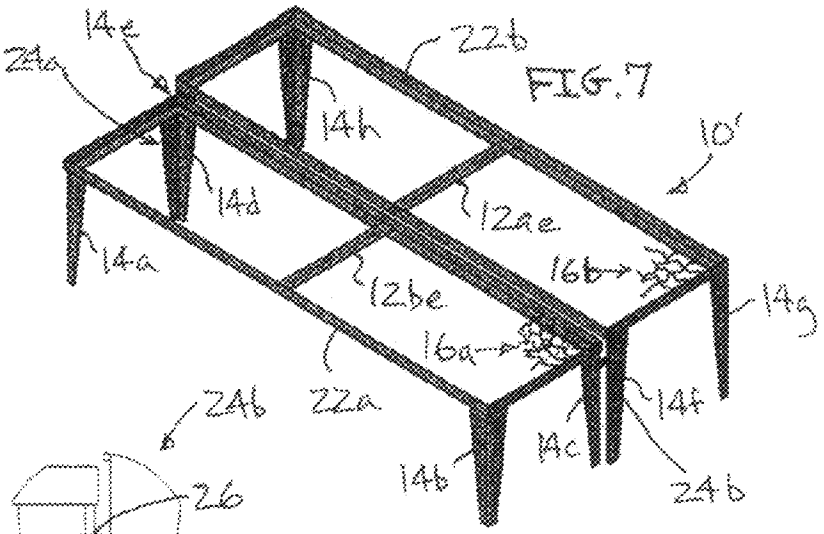
FIG. 7 is an isometric view of the bed corresponding with FIG. 4.
Figure 6:
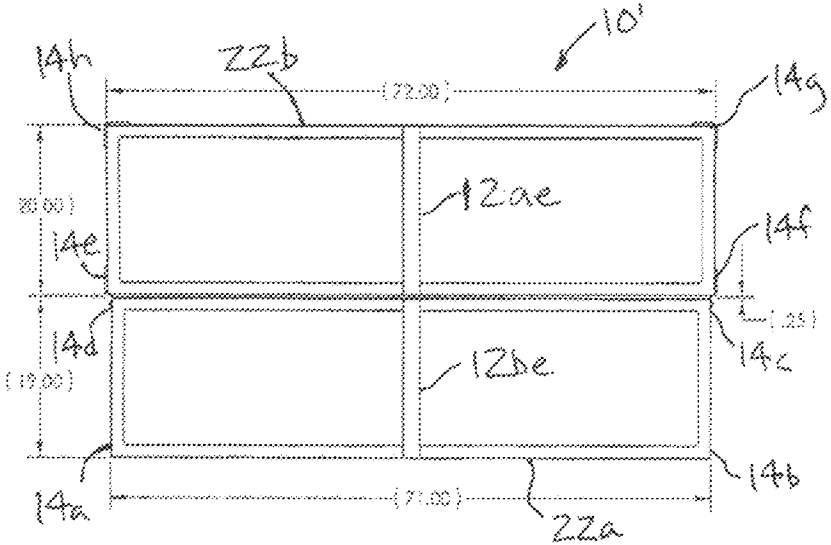
FIG. 6 is a front elevation of the bed corresponding with FIG. 4.

Unlike the legs of bed 10, the legs of bed 10' are not splayed. This permits frames 22*a* and 22*b* to be positioned side by side without a substantial lateral gap therebetween. The overall dimensions of frames 22*a* and 22*b* of bed 10' when configured side by side as shown in FIGS. 5, 6, and 7 are preferably approximately the same as those of bed 10 described above. Two half-sized (e.g. twin-sized) wire mesh infill expanses 16*a* and 16*b* (shown only in FIG. 7 and only in part, for the sake of clarity) mattresses 18*a* and 18*b* (shown in dashed outline in FIG. 5) are provided and fit within their respective one of frames 22*a* and 22*b*. Mattresses 18*a* and 18*b* can be of different nominal heights and the same compression to accommodate the different heights of frames 22*a* and 22*b*. Alternatively, mattresses 18*a* and 18*b* can be of identical nominal height and can be of differential compression effectively to level the plane of the mattresses' upper surface when in use.

Referring now particularly to FIG. 5 and DETAIL A, in accordance with on embodiment of the invention, bed 10' includes one or more (e.g. two) latching mechanisms 24*a* and 24*b* for securing frames 22*a* and 22*b* in a fixed, side-by-side position. Each of latching mechanisms 24*a* and 24*b* in accordance with one embodiment of the invention includes a pivotable catch 26 (which may be riveted to one or more of legs 14*e* and 140 and a corresponding post 28 which may be welded or otherwise affixed to one or more of legs 14*c* and 14*d*. Any suitable material may be used for catch 26 such as ⅛ inch steel, and any suitable material may be used for post 28 such as stiff steel rod.

Bed 10' shown in FIGS. 4-6 and DETAIL A is likewise preferably finished with a powder coating and a light (e.g. white or off-white) color to resist and highlight bugs, as discussed above by reference to FIGS. 1-3.

Those of skill in the art will appreciate that any suitable mattress for either bed can be provided but that for bug-resistance, a dense foam (e.g. so-called "memory foam") mattress is believed to be most suitable. This is because such foam mattresses—unlike traditional box-spring and companion upper mattresses—are "seamless." Seamlessness is important because seams tend to provide bedbugs with an invasion entry point and a harbor within voids or other open spaces within a traditional mattress. In contrast, there are no seams and no such voids in a dense foam mattress. One particular suitable foam mattress is available from Paramount Mattress, Inc. of Los Angeles, Calif., USA. Those of skill in the art will also appreciate that a seam-welded mattress slip cover preferably is used over the foam mattress for the same reason. Of course, suitably alternative mattress and slip cover designs are contemplated as being within the spirit and scope of the invention.

While such are not illustrated herein, for the sake of clarity, the bottoms of the bed's legs (its feet) can be equipped with removable pads of suitable material such as rubber or plastic so that the feet do not skid across or mar the floor or other support surface.

Those of skill in the art will appreciate that the smooth finish to the frame and legs of the invented bed in either embodiment makes it more difficult for bugs to climb onto the bed or remain thereon because the bugs can find no purchase. Those of skill in the art also will appreciate that the light-colored (e.g. white or off-white) finish to the frame makes any bugs thereon easily discovered. Bedbugs may have various origins, including the possibility that they were brought into the facility on the person or clothes of a guest of the facility. Thus, despite the unlikelihood of a bedbug crawling from the floor onto the invented bed, nevertheless bedbugs may find their way off of a guest or the guest's clothing, across the bedding and/or the mattress and onto the frame where the bedbugs are likely to be spotted (because of their contrasting color visibility) and where the bedbugs can be eradicated.

Those of skill in the art will appreciate the invented bed's openness, elegance, and simplicity, quite apart from its utility in resisting bug infestations.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. A bedbug infestation-resistant bed comprising:

a horizontal right-rectangular frame including four open angled rigid members pair-wise joined at their eight termini in four corners;

one or more support members extending across the frame near an upper edge of the joined angled members, wherein at least the four open angled rigid members, the one or more support members, and the four legs are formed of steel, and are powder coated so as to reduce frictional engagement with the feet of a bedbug; and a right-rectangular wire mesh infill expanse extending within a perimeter of the frame and supported by upper inwardly extending expanses of the joined angled members, the infill expanse being joined along its perimeter to the inside, lower edges of the joined angle members; and wherein each of the four legs include a stop at a defined elevation within an open angled interior region, the stop configured to rest atop an outside corner of a second, identical bed's frame when the beds are vertically stacked on one another, the placement of the stops relative to the height of the bed being configured to produce a consistent minimum spacing between adjacently vertically stacked beds.

2. The bed of claim 1 further comprising:

a right-rectangular, substantially solid-foam mattress extended across and supported by the infill expanse.

3. The bed of claim 1 further comprising:

four legs extending approximately vertically from and joined to the four corners to a support region therebelow, the four legs formed of solid rigid material.

4. The bed of claim 3, wherein the four legs also are open angled rigid members.

5. The bed of claim 3, wherein the four legs are splayed outwardly from the frame at an effective vertical stacking angle of between approximately three and approximately eight degrees from vertical.

6. The bed of claim 5, wherein the angle is approximately five degrees.

7. The bed of claim 5, wherein the rigid members are joined at their eight termini in four corners by welding, wherein the support member is joined to the frame by welding, and wherein the legs are joined to the frame by welding.

8. The bed of claim 7, wherein the color of the frame is white, off-white, or similarly light.

9. The bed of claim 7, wherein the infill expanse is formed of crisscross-woven steel wires.

* * * * *